United States Patent [19]

Chung

[11] Patent Number: 5,005,997

[45] Date of Patent: Apr. 9, 1991

[54] RE-INKING DEVICE AND METHOD

[76] Inventor: Seng Y. Chung, 205 Balestier Road #03-01, Singapore, Singapore

[21] Appl. No.: 333,221

[22] Filed: Apr. 5, 1989

[30] Foreign Application Priority Data

| | | | |
|---|---|---|---|
| Apr. 6, 1988 | [GB] | United Kingdom | 8808028 |
| Jun. 20, 1988 | [GB] | United Kingdom | 8814575 |
| Jul. 23, 1988 | [GB] | United Kingdom | 8817628 |

[51] Int. Cl.[5] ..... B41J 31/14

[52] U.S. Cl. ..... 400/197; 400/194

[58] Field of Search ..... 101/197, 198, 200, 201, 101/202, 202.1, 202.2, 202.3, 194, 195, 196, 196.1, 197, 202.4, 207, 208, 208.1

[56] References Cited

U.S. PATENT DOCUMENTS

| | | | |
|---|---|---|---|
| 4,126,715 | 11/1978 | Schiffmacher | 400/197 |
| 4,127,337 | 11/1978 | Bishop | 400/202.4 |
| 4,156,572 | 5/1979 | Carena | 400/197 |
| 4,390,294 | 6/1983 | Castro | 400/196.1 |
| 4,701,062 | 10/1987 | Ploeger | 400/202.1 |
| 4,806,032 | 2/1989 | Gragg et al. | 400/197 |

FOREIGN PATENT DOCUMENTS

| | | | |
|---|---|---|---|
| 141683 | 5/1985 | European Pat. Off. | 400/208 |
| 3435082 | 4/1986 | Fed. Rep. of Germany | 400/202.3 |
| 873467 | 5/1987 | South Africa | 400/196.1 |

OTHER PUBLICATIONS

IBM Technical Disclosure Bulletin, "Cartridge-Loading Mechanism" vol. 28, No. 2, Jul. 1985, pp. 482–483.

IBM Technical Disclosure Bulletin, "Aligning Pins for Cartridges" vol. 26, No. 7B, Dec. 1983, pp. 3810–3811.

*Primary Examiner*—Edgar S. Burr

*Assistant Examiner*—Joseph R. Keating

*Attorney, Agent, or Firm*—Scrivener and Clarke

[57] ABSTRACT

A re-inking device for a fabric ribbon carried in a cassette with a free run section of ribbon exposed for re-inking, in which the cassette support and location means, the rotational drive means and the combined ink reservoir and dispenser are all mounted to one side of a base member and are all movable relatively thereto. The invention also includes a method of re-inking a cassette fabric ribbon.

17 Claims, 12 Drawing Sheets

4
18
19
22
4

19
18

19
18
2
11
16
14
10
16
7
9
5
1
6
6

FIG. 21
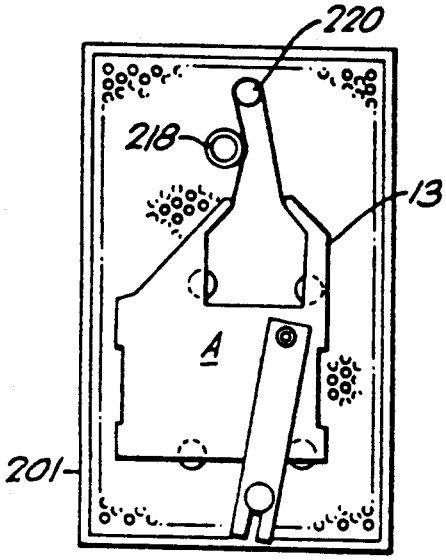
FIG. 22
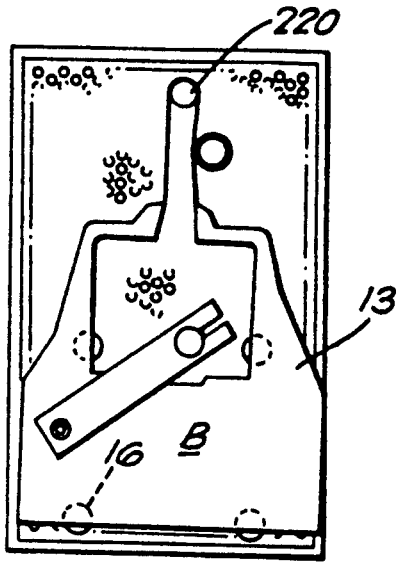
FIG. 23
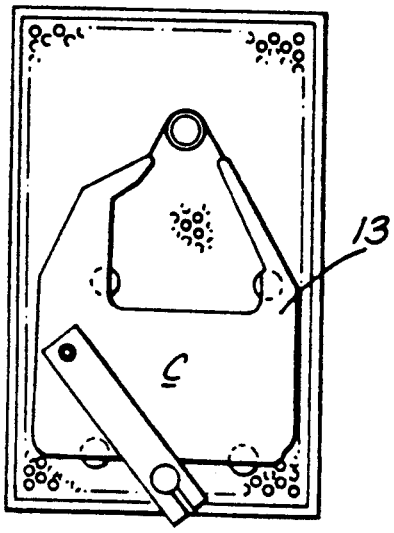
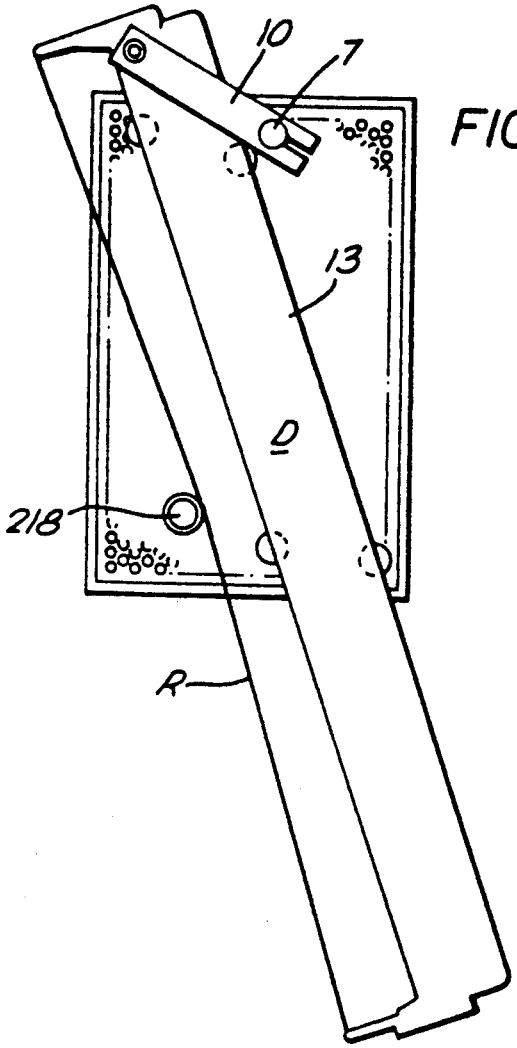
FIG. 24
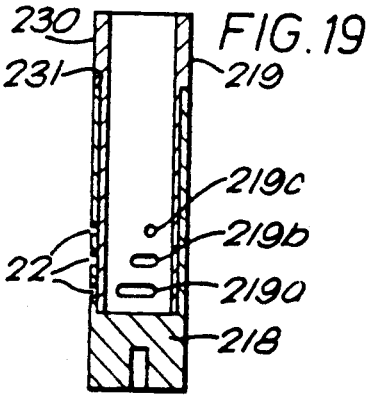
FIG. 19

352
307
354
310
356
358
370
351
348
350
312
364
14
13
392
390
319
R
316a
320
316b
348
316
346
17
386
17
344
301
342
340

RE-INKING DEVICE AND METHOD

This invention relates to a re-inking device and method, in particular for fabric ribbons or tapes.

Fabric ribbons and particularly multi-pass nylon fabric ribbons are widely used in various printers, for example in typewriters, cash registers, teller machines, telex machines and increasingly, in computer printers. Suitable ribbons are conventionally available from the manufacturers of the printers, ready inked. Most fabric ribbons are in the form of a continuous loop housed in a cassette (cartridge) of a plastics material, with each manufacturer having his own, recognisable, shape and size of cassette. In use the fabric is withdrawn and returned to the cassette when the cassette drive mechanism is rotated by the printer driver, with at least some of the ink carried by the exposed length of ribbon being transferred in known fashion to the material such as paper provided to receive the print. When the ink on the ribbon is depleted so that the print quality becomes unacceptable, it is usually assumed that the cassette will be discarded. with an appreciable replacement cost.

Two solutions to the cost of discarding cassettes with ink-depleted fabric ribbons are on the market. One solution is the fitting of a replacement pre-inked ribbon into an existing cassette, in place of the original ribbon; but this is often a difficult and messy process, not suited to the needs of ordinary cassette users. A second solution is the use of a re-inking device to re-ink the original ribbon without removal of the ribbon or dis-assembly of the cassette. It is this latter option with which this invention is concerned.

To reduce manufacturing costs, specifically to avoid having to make a special re-inking device for each make (size and shape) of cassette, it is known to make re-inking devices intended for the re-inking of a variety of cassettes. Such re-inking devices will be useful not only to users with a large number of printers, each using a cassette of a different design (as form a different printer manufacturer); but also by a user who has only a single printer, and who will set up his re-inking device for the appropriate cassette and thereafter leave the setting unaltered.

A re-inking device useful for re-inking the ribbons carried by a variety of designs of cassette will generally have a base, and on this base will be mounted {a} support means, of a dimension to support the cassette above the base such that the free run of the ribbon i.e. that ribbon section (temporarily) exposed between the cassette ribbon exit and ribbon entrance, will not be in rubbing contact with the base, {b} location means, laterally to locate the cassette against being pulled across the base whilst the ribbon is being pulled from the cassette for re-inking, {c} rotational drive means for the drive mechanism; since different makes of cassette have drive mechanisms of different shape and form, often the drive means will include adaptor means, of a size and shape to engage the drive mechanism of the cassette, the drive means being rotatable so as cause the adaptor means to turn the cassette drive mechanism to pull the ribbon from the cassette for re-inking, and {d} reservior means, to hold a supply of ink which can be dispensed therefrom to the ribbon at a suitable rate during re-inking.

Many cassette drive mechanisms have central openings including either a slot or a double slot (cross), of a width selected by the manufacturer; and for these cassettes the drive adaptor conveniently is a tapered blade, suitable for insertion to different depths (in accordance with the slot width) in such slot, so that the one (drive) adaptor means can successfully be used for the driving of cassettes from different manufacturers. But adaptor means having a "Y" cross section are known.

In a widely used re-inking device, the fabric is re-inked with the cassette in its so-called normal position i.e. the position the cassette occupies in the printer, with therefore the "bottom" face of the cassette (being the face which shows the drive mechanism) facing the base, pressed against the support means. The cassette is held in a substantially horizontal position during re-inking, with the drive means and most of the adaptor means below the base; the cassette location means and the ink reservior are to the other side of the base, alongside or above the cassette. Whilst this know arrangement has the advantage that the cassette can be fed onto the re-inking device with the same orientation as it is fitted into the printer, we have recognised two disadvantages {a} since the cassette drive mechanism is out of sight, many users find it difficult to centre it correctly over the (drive) adaptor means, and {b} it is difficult to ensure that the drive adaptor is projecting upwardly the correct distance, properly to engage the drive mechanism for full driving contact; light intermittent engagement of the drive mechanism results in irregular ink density and thus print density, whilst conversely the drive mechanism may be forced onto the adaptor blade and one or other may be damaged, usually the drive mechanism, rendering the re-inking pointless since the cassette can not thereafter be driven in the printer. Such known arrangements often include a hold-down or pressure bar to hold the cassette against the support means, whilst itself acting as the location means, relying on the friction between the cassette and support means to prevent or limit slippage.

It is also known in one commercially-available device for the cassette to be inverted during re-inking i.e. with its "bottom" face upward, and to position the drive adaptor and the drive means above the cassette. Thus the cassette support, the cassette location means, the drive adaptor, the drive means for the drive adaptor and the ink reservior are in this design all to one side of the base on which they are mounted. However, in this known arrangement, at least the cassette support (and usually also the ink reservoir) is immovably fixed to the base. This re-inking device is therefore suited for re-inking only a limited number of selected proprietary cassettes i.e. those for which the free run of the ribbon can rub against the reservoir ink dispensing outlet when the selected cassette is suitably mounted upon the fixed-position support. The adaptor means is mounted on an arm of adjustable radius so that it can fit into the cassette drive mechanism, but its loading cannot be balanced for all cassettes and often with a short radius arm the adaptor tends to jump out of engagement.

We seek to remove or reduce the above disadvantages.

Thus according to one feature of our invention we provide a re-inking device for a fabric ribbon carried in a cassette having a rotatable drive mechanism and shaped to provide an exposed free run section of the ribbon comprising a base upon which is mounted cassette support means, cassette location means, rotational drive means for the cassette drive mechanism, and reservior means having an ink dispensing outlet engagable by the free run section of the ribbon characterised in that all the said means are to one side of the base, and in that each of the said means is movable relative to the base. Preferably the cassette support means comprises a plurality of support surfaces, as does the cassette location means, whereby a second cassette of different configuration and containing a fabric ribbon can be supported by and located relative to the base and a free run section of that ribbon be re-inked.

We also provide a method of re-inking a cassette which includes the steps of positioning cassette support means and cassette location means on a base to receive and locate a selected cassette having a ribbon to be re-inked and having a drive mechanism adapted to withdraw a length of said ribbon to form a free run ribbon section, selectively positioning and locating the cassette on and by said means with its drive mechanism facing away from the base, inserting a drive means in said drive mechanism, placing an ink dispenser in contact with at least part of said free run ribbon section, and rotating the drive mechanism by said drive means to withdraw successive free run sections until all of said ribbon has been re-inked.

The invention will be further described by way of example with reference to the accompanying drawings in which:

FIG. 19 is a sectional view of a modified ink reservior;

FIG. 21–24 are plan views of different designs of cassette mounted on the base board as shown in FIG. 18.

Figures 1, 3, 4:
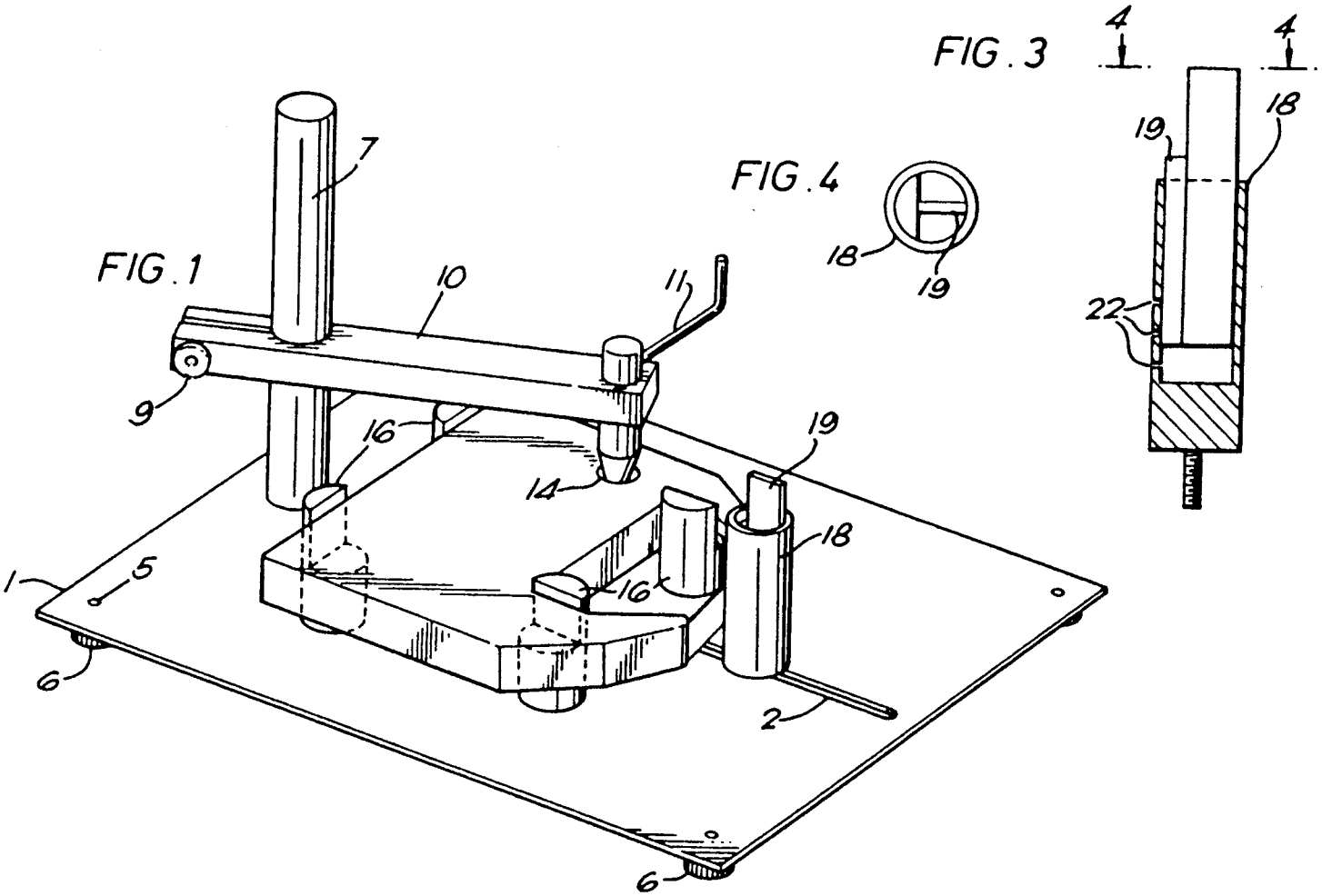
FIG. 1 is a perspective view of one embodiment of re-inking device according to the invention.
FIG. 3 is a part sectional view of the ink reservoir used in the embodiment of FIGS. 1, 2.
FIG. 4 is a plan view on the line 4—4 of FIG. 3.
Figure 2:
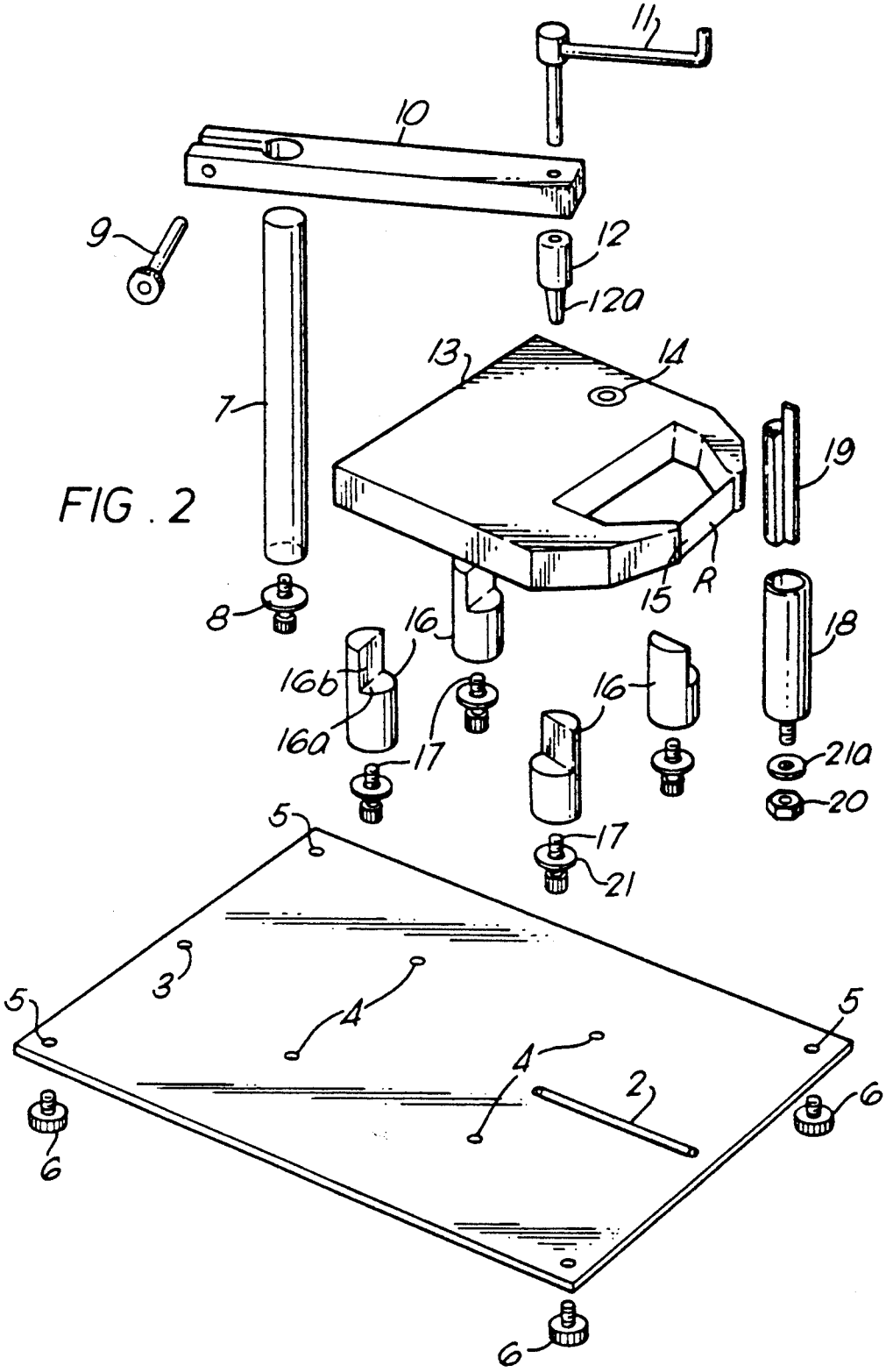
FIG. 2 is an exploded view of the device as shown in FIG. 1.
Figure 5:
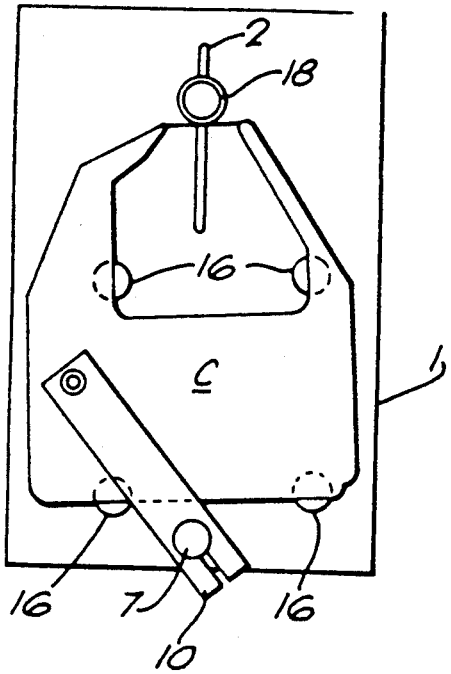
FIG. 5 is a plan view of the embodiment of FIG. 1, showing one proprietary design of cassette in a position to be re-inked.
Figure 6:
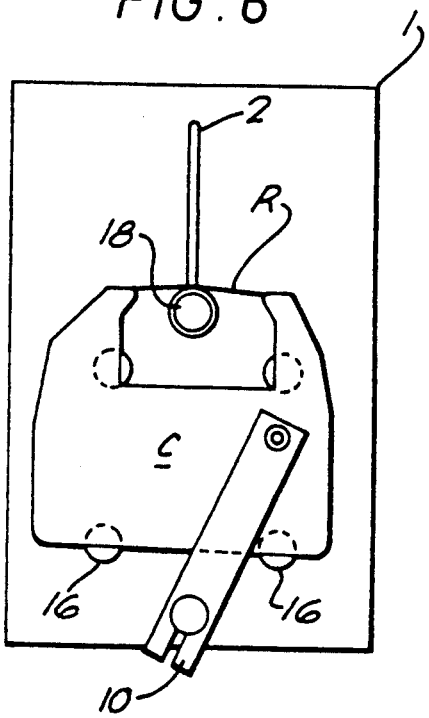
FIG. 6 is a view similar to that of FIG. 5 but with a second proprietary design of cassette.
Figure 7:
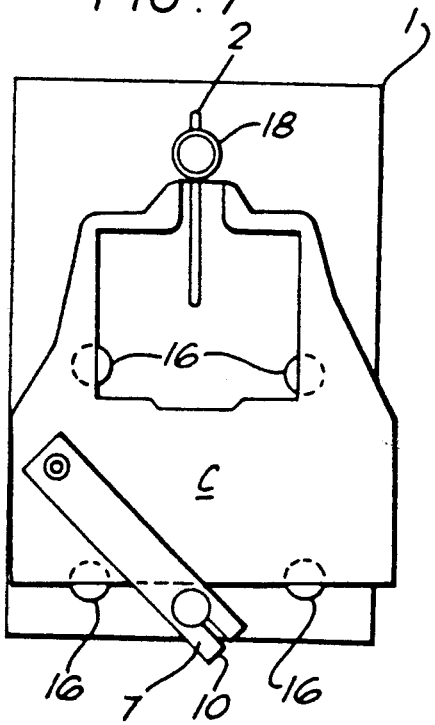
FIG. 7 is a view similar to that of FIG. 5, but with yet another proprietary design of cassette.
Figure 8:
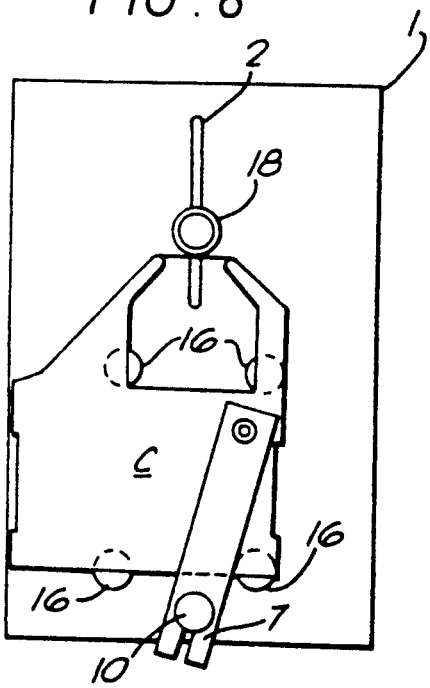
FIG. 8 is a view similar to that of FIG. 5 with a fourth design of proprietary cassette.
Figure 9:
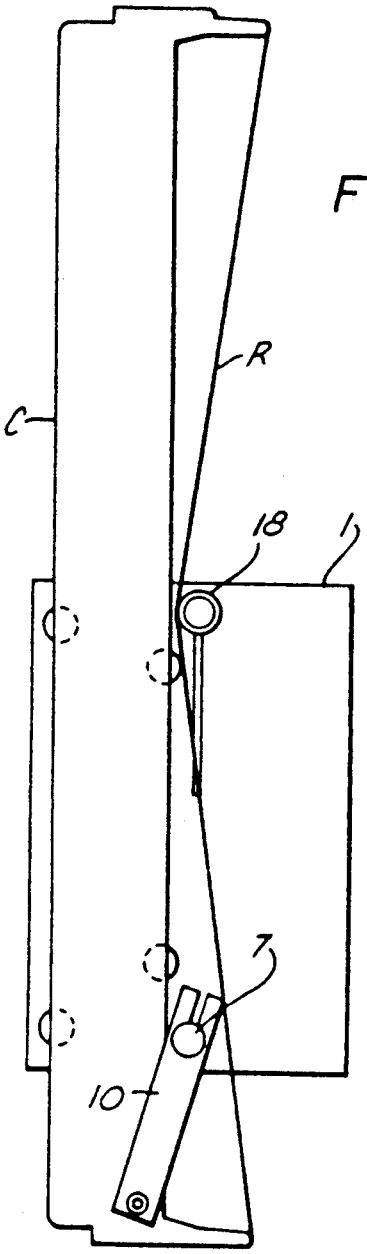
FIG. 9 is a view similar to that of FIG. 5 but with a fifth design of proprietary cassette.
Figure 10:
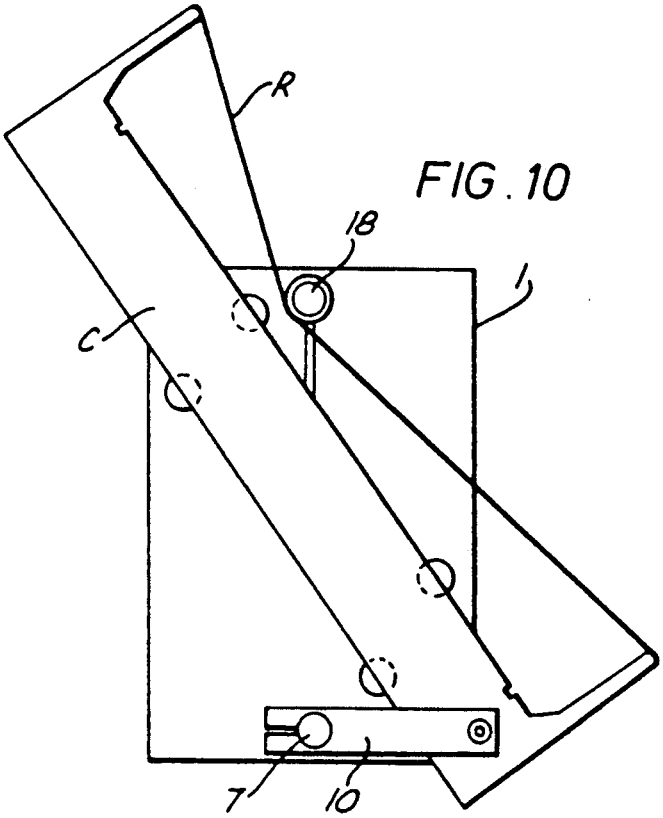
FIG. 10 is a view similar to that of FIG. 5 with a sixth design of proprietary cassette.
Figure 37:
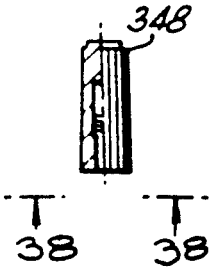
FIG. 37 is a side view partly in section, of a nut for use in the support element of FIG. 35.
Figure 39A:
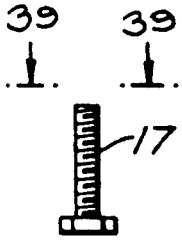
Figure 36:
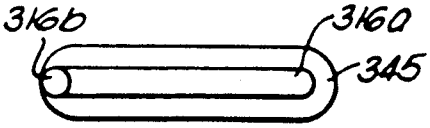
FIG. 36 is a view on the line 36—36 of FIG. 35.
Figure 38:
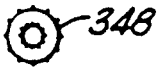
FIG. 38 is a view on the line 38—38 of FIG. 37.
Figure 39:
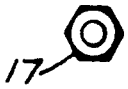

FIG. 39*a* is a side elevation of a screw for use with the nut of FIG. 37;

FIG. 39 is a view on the line 39—39 of FIG. 39*a*;

As seen in FIG. 1, and in the exploded view of FIG. 2 the base is a plate or board 1, conveniently of a hard wearing plastics such as ABS nylon. Plate 1 is rectangular and sits generally horizontally in its position of use on four rubber grommets 6, secured in base plate 1 by screws 6 through holes 5. A post 7, vertical or nearly so in its position of normal use and circular in cross-section, and also of ABS nylon, is secured to the base plate 1 by a screw 8 passing through hole 3. Four support studs 16 are individually secured to base plate 1 by screws 17 carrying washers 21 and passing through holes 4. Ink reservoir 18 is located at a selected position along a slot 2 in base plate 1 by screw 20 carrying a washer 21*a*; the ink reservoir 18 in use is located along slot 2 so that it is in contact with the free run R of the ribbon, and orientated so that ink in the reservoir 18 will discharge through one or more ink dispensing outlets, shown as orifices 22, onto the ribbon.

Each stud 16 has a shoulder 16*a* and an upstanding wall 16*b*, the shoulders 16*a* providing the cassette 13 support means, and the upstanding wall 16*b* providing the cassette 13 lateral location means. Shoulders 16*a* are at a height so that ribbon free run R does not rub against the base plate; and at a height so that the usual rotatable "thumb knob" extending from the cassette top face (and for some makes of cassette also the fins or grips used to hold the cassette whilst the thumb knob is turned) is (proud of) the base board 1.

It will thus be understood that the cassette 13 is shown mounted in an inverted position, with its "bottom" face upwardly and the top face (not seen) facing the base plate 1. The recessed center on the driven wheel will have one of a variety of recesses, according to the design criteria of the proprietary cassette supplier. Often the recess will be a slot or a cross, so that the driver can be a flat blade 12*a*, preferably decreasing (tapering) in width and depth towards its lower end so as to fit into slots of different widths and depths; however the centre of the cassette drive mechanism can have an alternative shape e.g. triangle, square, Y, etc. and then an alternative drive adaptor can be fitted, or a small suitably-shaped connector inserted between the blade and the cassette drive mechanism.

With cassette 13 in the inverted position, a drive adapter 12, which in this embodiment includes a blade 12*a*, is locked onto a dual-direction manual winding spindle and crank arm 11, providing a rotational drive means for the cassette drive mechanism 14; drive adaptor 12 is thereby mounted on fixed-radius arm 10. Cassette 13 can be adjusted in position by lateral and/or rotational adjustment of one or more of the studs 16, until blade 12*a* can be inserted accurately and correctly to the mating depth into the cassette drive 14; if the weight of the various drive adaptors available is known, blade 12*a* engages with a predetermined loading. The arm 10 is pivotably mounted on vertical post 7, to swing in a substantially horizontal plane, and can be locked at any height or angular position thereon by tightening of the screw 9. In an alternative embodiment a reversible electric motor is mounted on the radius arm 10.

The ink reservoir 18 has orifices 22 (FIG. 3) at different vertical heights, passing through the reservoir wall from an ink holding chamber, and one or more of these orifices can be closed by a shutter 19. For a narrow width fabric (such as that known as ¼ inch), ink will be dispensed only through the lower orifice, whilst for a wider fabric (½ inches), ink will be dispensed through two or perhaps all three orifices 22, with the height of shoulders 16*a* and/or of the ink reservoir 18 being adjusted if necessary by respectively fitting extra washers 21, 21*a*. With a continuous loop fabric it is helpful to paint a white dot on the ribbon 15, to provide a visual indication of the starting and ending points for the re-inking. Following re-inking, the ribbon will preferably be left for several hours before use, for the ink to migrate uniformly across the fabric width. Below the ink holding chamber is a mounting section, for the reservoir to be releasably fixed to the base board 1.

FIGS. 5–10 show the versatility of the re-inking device according to the invention, with a variety of different cassettes C each of different size and shape, and each with a differently positioned driving mechanism 14, and each with a different free-run position R for the fabric to be re-inked. Furthermore, it will be understood from the above description that the different cassettes are likely to have a differently-shaped central recess for their cassette drive 14, requiring that the radius arm 10 be affixed on post 7 at a (slightly) different height, and/or that a different adaptor be fitted onto the winding spindle 11, or that a connector slotted to fit on the blade 12*a* of adaptor 12 and having at its other end the required cassette drive shape is drivably positioned between adaptor 12 and cassette drive 14.

The embodiments as so far described are dedicated to a selected one proprietary cassette. The studs 16 are individually rotatable in the four respective holes 4 to permit their upstanding wall 16*b* to take up any minor lateral tolerance differences, as are radius arm 10, vertical post 7 and reservoir 18; it will however be further understood that base board 1 can in an alternative embodiment as more fully described below have more than four holes 4, both so that more than four studs can be used if required (even in a dedicated embodiment), and so that the four (or more) shouldered studs 16 can be re-positioned on the board i.e. so that this alternative embodiment is also suited for the re-inking of the ribbon of different designs of cassette.

Figure 11:
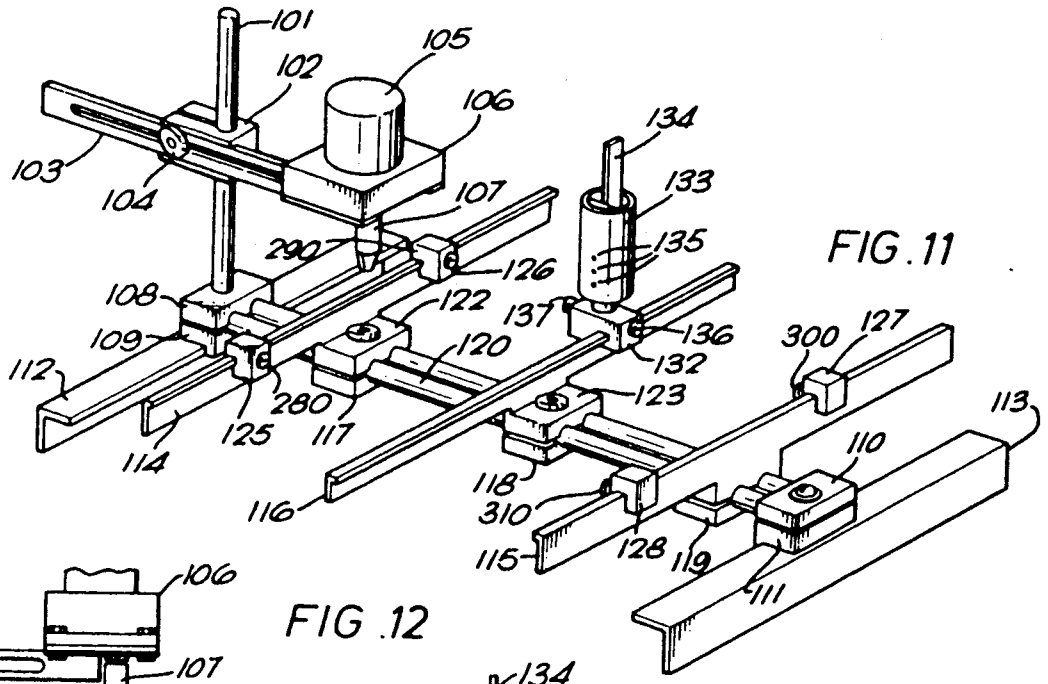
FIG. 11 is a perspective view of a second embodiment of re-inking device according to the invention.
Figure 12:
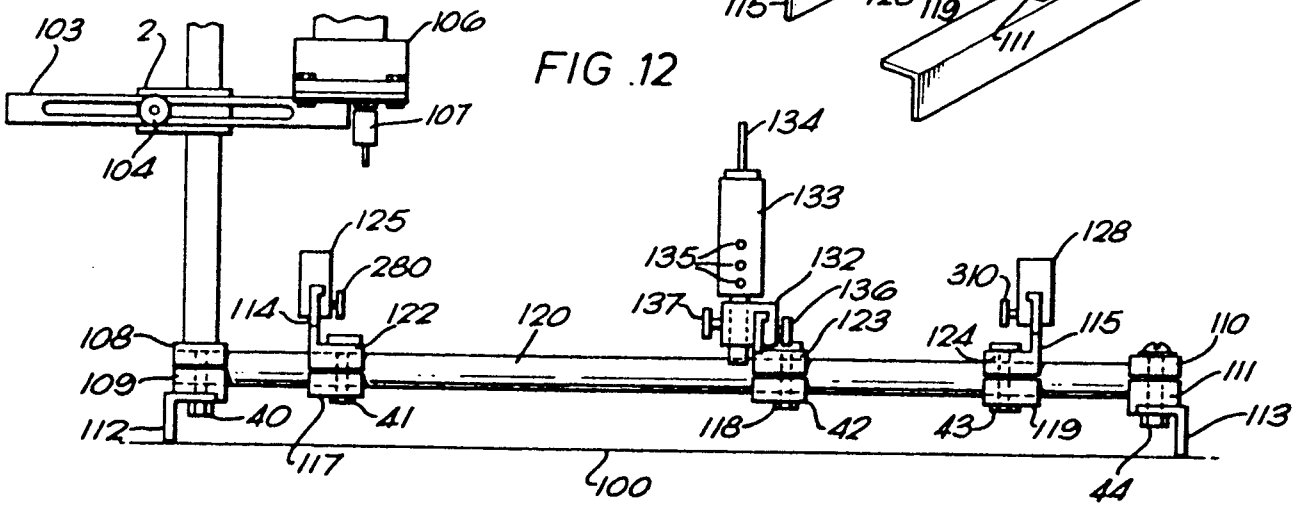
FIG. 12 is a side elevation of the re-inking device of FIG. 11.
Figure 13:
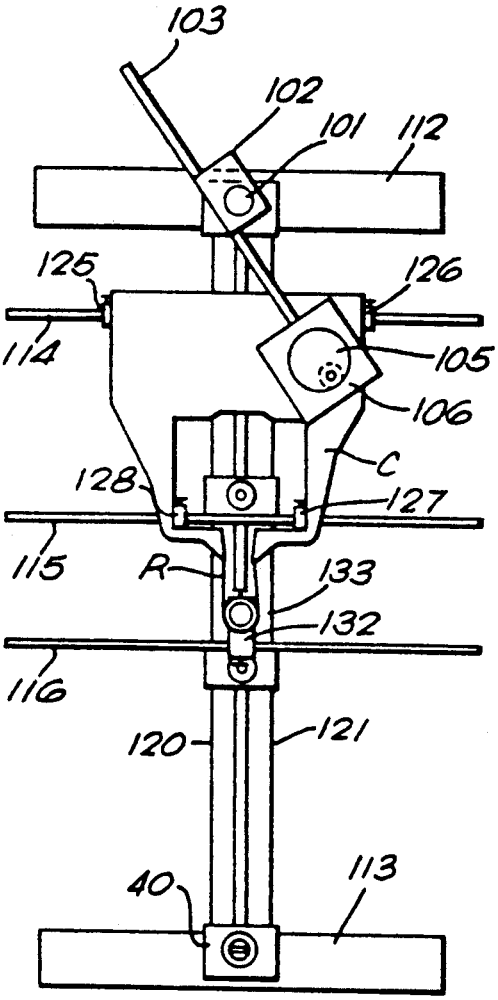
FIG. 13 is the re-inking device of FIGS. 10, 11 shown with one design of proprietary cassette ready for re-inking.
Figure 14:
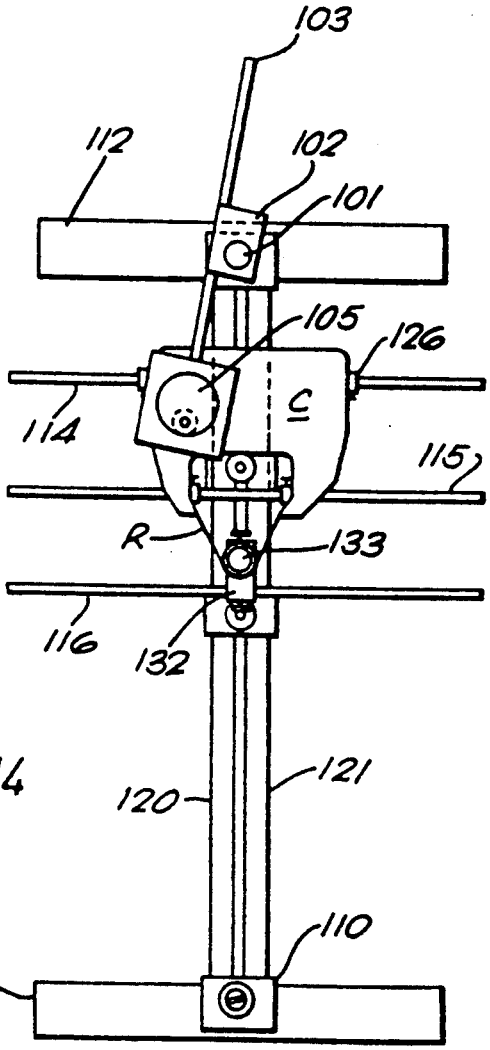
FIG. 14 is a view similar to that of FIG. 12 but with a different proprietary cassette.
Figure 15:
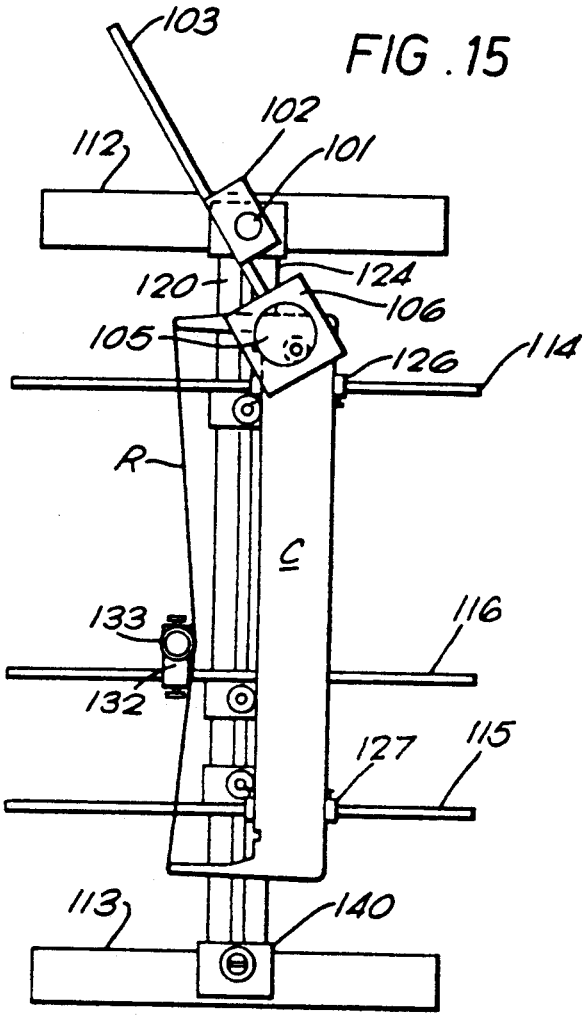
FIG. 15 is a view similar to that of FIG. 12 but with a third proprietary cassette.
Figure 16:
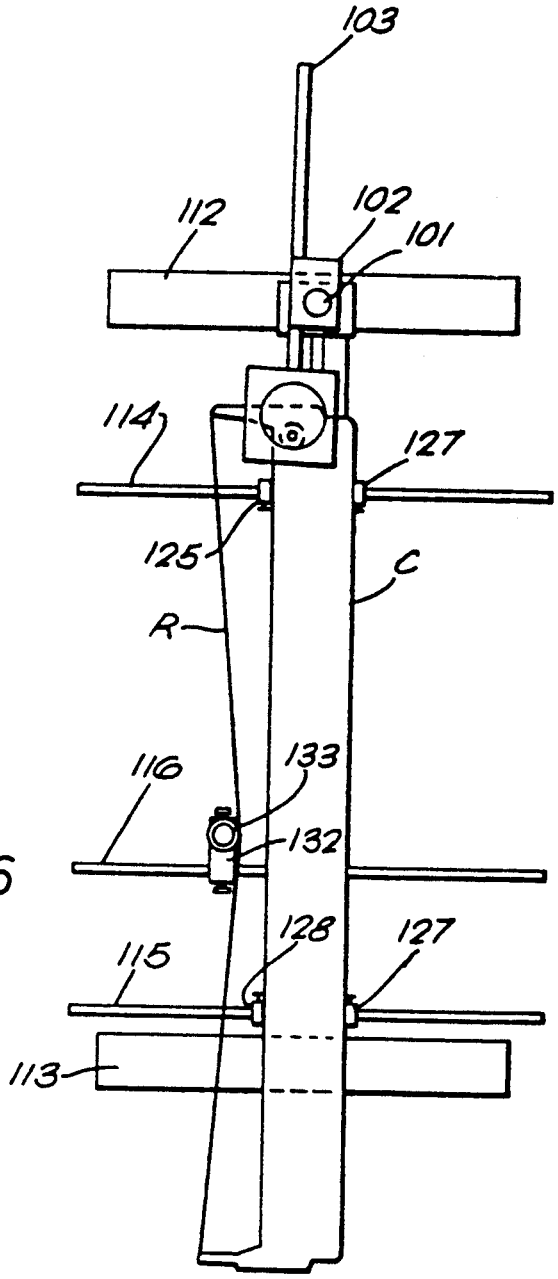
FIG. 16 is a view similar to that of FIG. 12 but with a fourth proprietary cassette.

For commercial organisations desiring to re-ink cassette fabric ribbons from a variety of printers, I propose also an alternative embodiment, as seen in FIG. 11/12. The base is a structure comprising angled bars 112 and 113, spaced parallel guide rails 120 and 121, vertical post 101, and at one end mating link blocks 108, 109 holding one end of the guide rails 120, 121 and at the other end mating link blocks 110 and 111 holding the other end of each guide rail. In an alternative embodiment the pair of guide rails 120, 121 can be replaced by U-channel, with a central slot acting as a supporting spline for the three support arms 114, 116, 115, with the three bolt heads received in the U-channel, with their respective shanks protruding upwardly through the slot. In a further alternative embodiment, the angle bars 112, 113 can be replaced by solid (square or rectangular) bars, having vertical apertures so that the bars can be directly secured to the top of a work bench. In use, the angle bars 112, 113 will be positioned in a horizontal plane, for example with an angle bar to either end of or on top of a work bench 100 (FIG. 12).

Adjustably secured to vertical post 101 is a slider block 102. Tightening of slider block 102 by screw 104 also locates a (variable) radius arm 103, on which is mounted motor 105 and reduction gearbox 106. Motor 105 is a DC motor, the speed of which can be varied. The direction of rotation of motor 105 can also be varied, in accordance with the rotational direction desired for drive adaptor 107.

Two parallel cassette support bars 114, 115 are respectively mounted on the guide rails 120, 121 by way of clamping blocks 117, 122 held by screw and nut 41, and by clamping blocks 119, 124 held by screw and nut 43. Slideably mounted on the cassette support bar 114 are stoppers 125, 126, releasably locked by screws 280, 290; and slideably mounted on cassette support bar 115 are stoppers 127, 128, and which can be re-located after releasing respective locking screw 300, 310. The sliding stoppers can be locked so that their vertical surfaces (usually those vertical surfaces perpendicular to the support bar) can act as the location means for a cassette during re-inking i.e. to restrain the lateral movement of the cassette as the ribbon is being advanced by the motor 105; and since the cassette rests on the support bars in this embodiment these are thus the cassette support means.

A reservoir support bar 116 is also mounted on guide rails 120, 121, by clamping block 118, 123, held by screw and nut 42. As can be seen best from FIG. 2, the top ledge of reservoir support bar 116 is at a lower level than that of the cassette support bars.

The ink reservoir 133 is held by slidable support 132, which can be locked in any position along the support bar 116 by screw 136; the height and direction of the orifices 135 through which the ink is dispensed from reservoir 133 can be adjusted after loosening locking screw 137. Closure of the reservoir, or opening of the lower, lower and middle, or lower and middle and top orifices 135, can be controlled by the height of shutter 134 in reservoir 133. The location of reservoir 133 in relation to the position of the cassette, and in particular to the position of the free run R of the ribbon between the cassette arms, for a cassette mounted on parallel cassette support bars 114, 115, is preferably adjusted to impose a minimum drag on the ribbon, and thus the minimum strain in the ribbon advancing mechanism.

The embodiment of FIGS. 11–12 allows continuous adjustment, and so may be better suited to the needs of commercial and more frequent users than the embodiments having lateral adjustments in discrete steps, and with release and removal of a component before re-positioning and re-tightening.

FIGS. 13–16 indicate the use of the re-inking device of FIGS. 11–12 for the re-inking of alternative designs of ribbon cassette, from which it can be seen that the re-inking device according to the invention permits rapid and simple re-positioning of one or both of cassette support bars 114, 115, of reservoir support bar 116, of sliding cassette stoppers 125, 126, 127 and 128, of the ink reservoir 133, as well as of the motor mount 102, 103. The cassettes are generally indicated by C and the exposed free-run portion of the ribbon by R.

Figure 17:
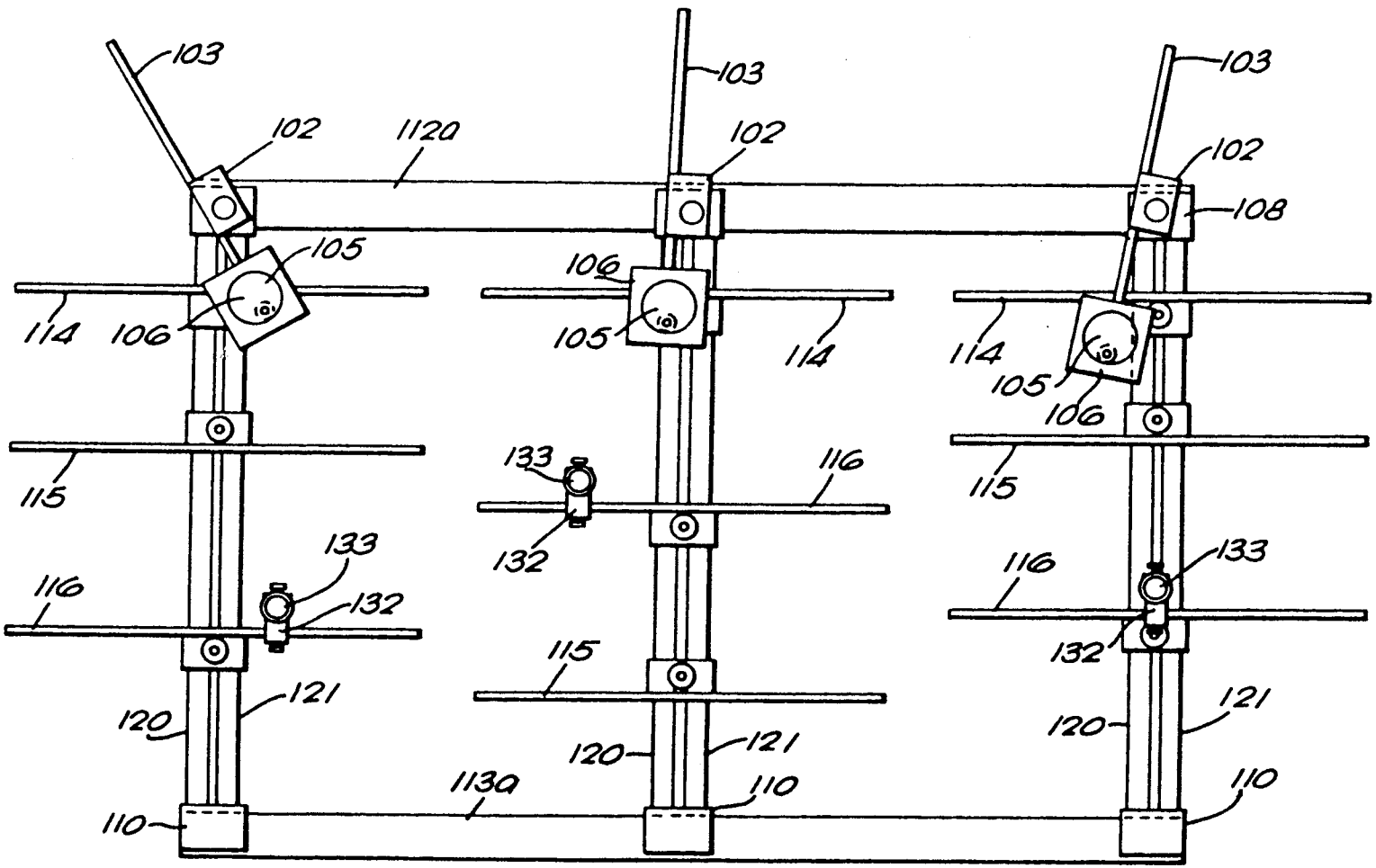
FIG. 17 is a plan view of a multiple drive arrangement for re-inkers according to FIGS. 11, 12.

Larger operators may require a multi-drive unit, wherein several cassettes (of the same or of different size/shape) can be re-inked simultaneously, e.g. for a commercial re-inking operation. This can be achieved by mounting the link blocks carrying guide rails 120, 121 onto a suitably extended base e.g. angle bars 112*a*, 113*a*, as in the three-drive unit of FIG. 17.

Figure 20:
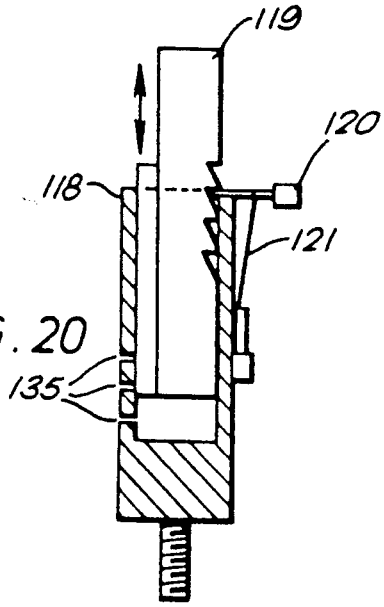
FIG. 20 is a cross-sectional view of an alternative design of reservoir for use in the invention.

An alternative embodiment or reservoir is shown in FIG. 20. Again the shutter 119 is a sealing, sliding fit within the reservoir 118. It is held in its selected vertical position by a pawl and ratchet device, with the pawl 120 biased by spring 121 into one of the ratchet positions. This embodiment could be of particular use in a multi-drive arrangement, such as that of FIG. 17, and which may suffer vibration as two or more cassettes are simultaneously re-inked.

It will therefore be understood that I have provided an arrangement whereby the cassette or cartridge can be accurately and adjustably positioned bottom-face up (inverted), so that a top-mounted driver can be removably inserted into the recessed centre of the driven cassette wheel. By using a two-direction rotational handle or motor, the driven wheel can be rotated clockwise or anticlockwise as required for the particular cassette design; furthermore one drive adaptor can be used for oppositely-rotatable driven wheels (as compared to threaded replacement adaptors having either a clockwise or anticlockwise thread and which need to be supplied in pairs). With a reversible drive means, preferably a motor, and with the height and lateral positioning adjustments possible with my embodiments, combined preferably with a tapered driver, a wide range of cartridge designs can be processed effectively, using a comparatively small number of drive adaptors. It will be further understood that in the embodiment of FIGS. 1, 2 the fixed radius arm can be sized such that the majority of manufacturer's cassettes as used by the home computer user for example can be accommodated by simply varying the position of the support studs and reservoir location i.e. a standard sized base board, with a fixed position vertical post and a common fixed radius arm 10 can be purchased by a variety of potential users, and adapted to fit their specific shape of cassette (cartridge), with self-punched holes as a possible alternative to the pre-punched holes 4.

Figure 18:
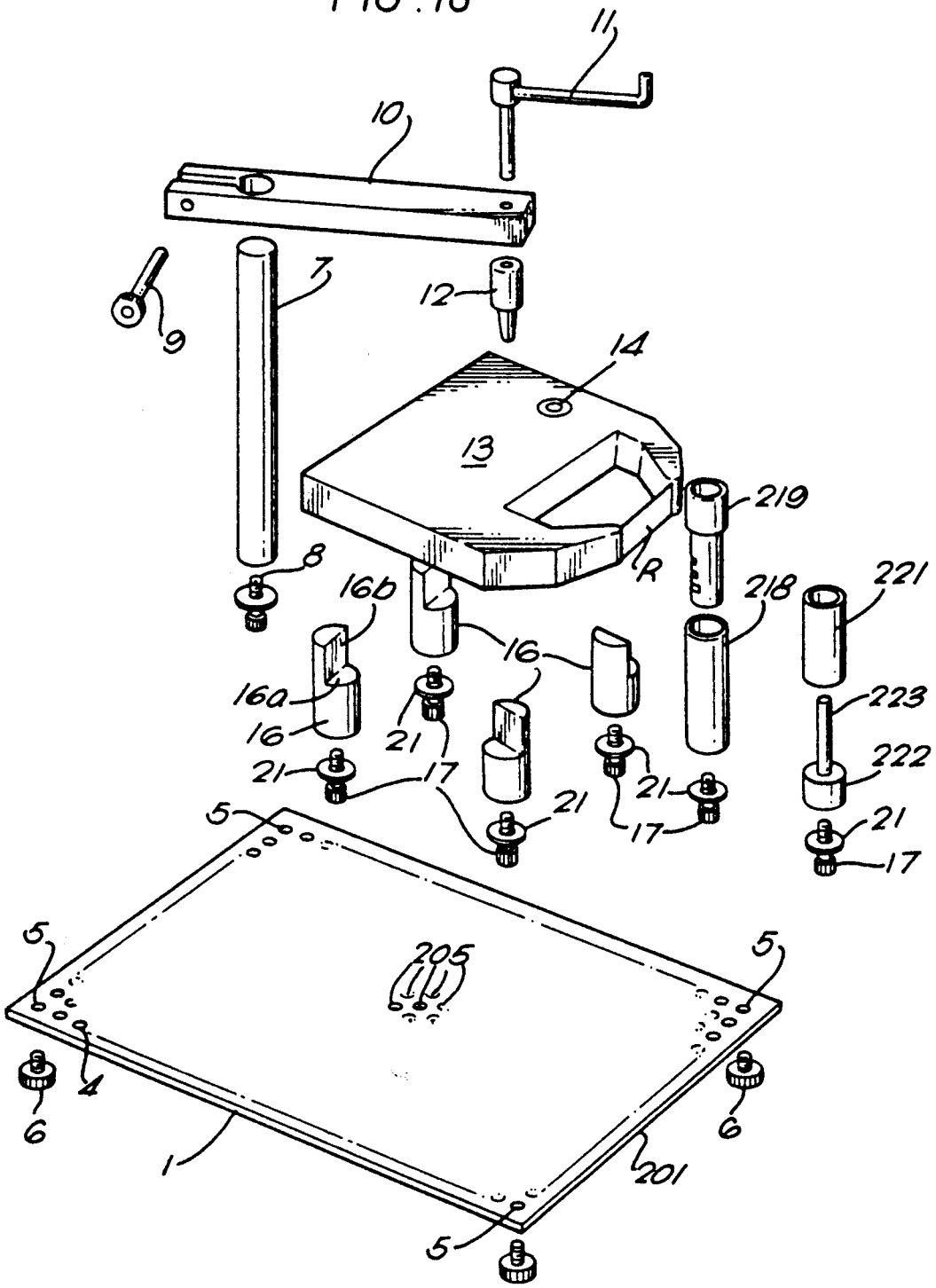
FIG. 18 is an exploded, perspective view of an alternative embodiment of re-inking device according to the invention, and with a "honeycomb" base board.

In the modified embodiment as seen in FIG. 18, the base plate or board 201 is rectangular and sits on four rubber grommets 6, secured in base plate 201 by screws 6 through corner holes 5. In this embodiment, the base board 201 has a plurality of holes therethrough, each of the same diameter as corner holes 5, in a honeycomb array. Each of these holes is numbered 205. In an alternative embodiment, the through-holes at the corners and/or other than at the corners are replaced by detents in the upper face of the base board into which can fit laterally-expandable clips adapted to grip the sides of the detents, the clips being mounted on the means listed in paragraph 2 of this specification.

A post 7, vertical or nearly so in its position of normal use, is secured to the base board 201 by a screw 8 passing through a hole 205. Four support studs 16 are individually secured to base board 201 by screws 17 carrying washer 21 and passing through respective holes 205. Ink reservoir 218 is located at a selected position on the base board 201, as by screw 17 passing through a washer 21. The ink reservoir 218 in use is located so that it is in contact with the free run R of the ribbon, and orientated so that ink in the reservoir 218 will discharge through one or more of the orifices 22 (FIG. 19) in the wall of the ink reservoir.

The reservoir orifices 22 are at different vertical heights, and in this embodiment they can be closed by a hollow cylindrical shutter 219 which can rotate as a sliding fit within the body of ink reservoir 218. Shutter 219 has an upper portion 230 with a shoulder 231 adapted to sit on the top of the reservoir 218, to align openings 219*a*, 219*b* and 219*c* vertically with orifices 22. If required, the cap can have an air-tight cover, to prevent the ingress of dust into the ink, and to help prevent egress of ink when the reservoir is not in use; the cover will be removed when ink is to be dispensed. In an advantageous alternative embodiment, the ink reservoir is a replaceable cartridge, with an ink capacity of 3ml, the orifices originally being sealed by a wrap-around aluminium foil; the cartridge is capped by a replaceable plastics cap having a central air hole, the air hole being closable to prevent release of ink by a top cap integral with and normally cupped over the replaceable cap, ink flow occurring when the foil and top cap are removed.

In use, for a narrow width fabric, ink is dispensed only through the lowermost orifice 22 as seen in FIG. 19, and to achieve this the shutter 219 is rotated so that the left hand section only of opening 219*a* (as seen in FIG. 19) is aligned with the lowest opening 22. For the widest width fabric, the shutter 219 is rotated so that uppermost orifice is in alignment with opening 219*c*, and because in this embodiment the openings 22 are vertically disposed the right hand end sections of openings 219*a* and 219*b* are now also aligned with their respective orifices. Preferably therefore the opening 219*c* has a horizontal length equal to or slightly less than that of its associated orifice 22, whilst openings 219*b* and 219*a* have a horizontal length double and treble that length. It will however be understood that other shapes, sizes and dispositions of the holes and/or orifices can be arranged, in accordance with proper dispersion of the ink across the full fabric width of both narrow, intermediate and wide fabrics.

As seen in FIG. 18, the idler roller 220 comprises a support 222 which can be affixed to base board 201 as by screw 17 with washer 21, and a roller 221 which is mounted for free rotation on an upstanding spindle 223 from support 222.

FIGS. 21–24 show the versatility of the fixing by way of honeycomb base 201, using a fixed-radius arm 10. Various existing proprietary designs A,B,C,D of cassette have a free run R which is drawn across in slight rubbing contact with reservoir 218, following proper positioning of the reservoir and, for cassettes A and B, of the idler roller 220. The design of base board 201 not only permits these various proprietary designs of cassette to be fitted, but often an individual cassette can be located at a more suitable position on the base board e.g. to suit the operator's convenience, or length of arm etc.

A particular feature of base board 201 is that the through apertures are all of the same diameter, and that the mountings for the individual components thereon are standardised. I propose using the so-called M4 cap screws. With the easier cassette positioning available with my modified base board, it may be possible, if desired, to locate at a fixed position on the base board one or more of the means listed in paragraph 3 of this specification and alter the respective positions only of the remainder, laterally and/or angularly.

Figure 25:
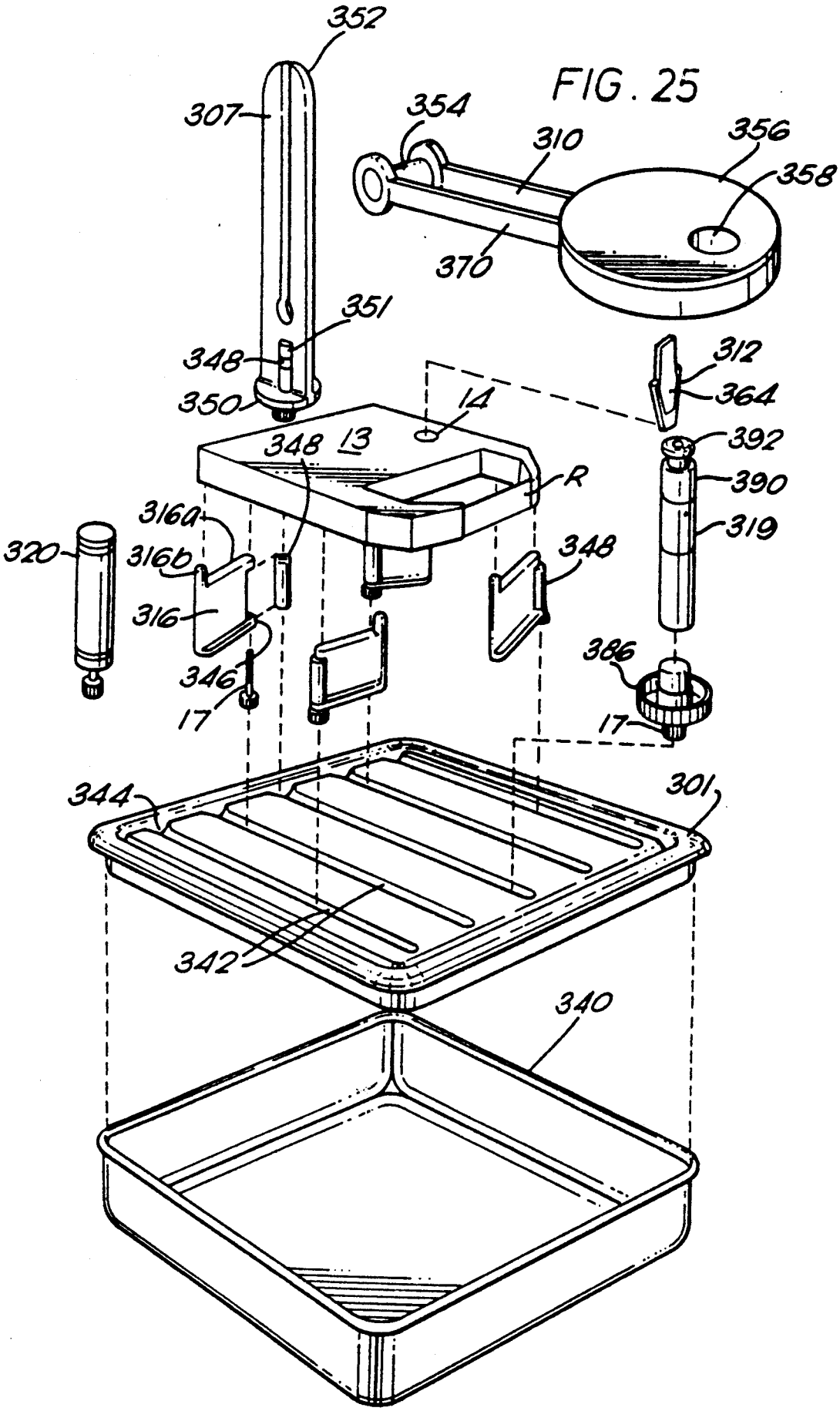
FIG. 25 is an exploded perspective view of one embodiment of my invention.

In the embodiment of FIG. 25, base lid 301 is a cover for component container 340 in which the various components used in the ribbon re-inking device according to this invention can be stored and perhaps transported when not in use, conveniently in shaped recesses in a layer of foam. Base lid 301 has five slots 342, in this embodiment each open at one end 344, the slots being formed from raised portions of the lid so that the slots are not through-slots. The slots are of a size to receive and retain the heads of screws 17, such that the screws 17 can be slid into the slots from the open end 344, and then backwards and forwards therealong as desired. The sides of the slot can be shaped to inhibit turning of a screw. In alternative embodiments there are different number of slots the slots are formed by recessed portions of the lid, the slots are through slots, and the slots are closed at each end but with one end widened to form a key-hole shape slot.

The individual components to be described hereinafter are respectively held on the base lid 301 by means of one of these screws 17; though in an alternative embodiment a component can be held by more than one screw, received in the same or different slots, or by a screw member having screw parts in more than one slot.

Figure 26:
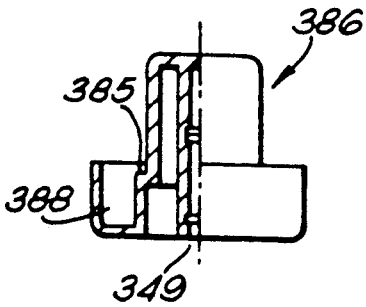
FIG. 26 is a side elevation of an annular cup for receiving the ink cartridge, partly in section.
Figure 35:
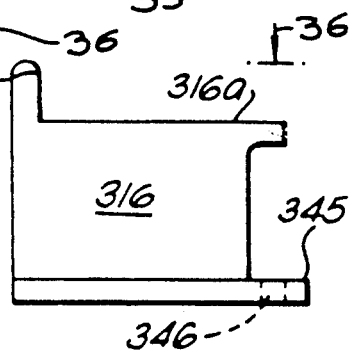
FIG. 35 is a side elevation of a support element.

In one embodiment at least one component, such as stud 316, has a flange 345 (FIG. 35) at one end, with an aperture 346 through which the screw shank can pass. Around the screw shank is threaded a locking nut 348 (FIG. 37) which can be tightened against the flange to locate the component at a selected position along its slot, and at the required angularity. In a particularly useful embodiment, flange 345 is not present, but there is a slot through which the screw shank can pass, permitting for example the stud 316 additional lateral adjustment; preferably the nut 348 will in this alternative embodiment be replaced by a flat locking nut (i.e. having a diameter greater than its height). In a further alternative embodiment the component has a threaded flange aperture, or a threaded (vertical) recess 349 (FIG. 26) with which the screw thread cooperates.

In yet a further embodiment, one component to be so mounted on the base lid 301 is a winding arm post 307. Winding arm post 307 in this embodiment is substantially flat, but has a mounting flange 350 which can rest against portions of the base lid 301 between adjacent slots 342; as seen in FIG. 25, screw 17 is received in nut 348 located in vertically-extending recess 351 (FIG. 25) in winding arm post 307. In an alternative embodiment screw 17, as generally described above, can pass through an aperture in the flange 350, to engage with a nut, and in a further alternative embodiment the recess 351 in winding arm post 307 is itself tapped, with winding post 307 then being threaded onto screw 17.

Winding arm post 307 includes a slot 352 into which can be passed strut 354 of winding arm 310. Winding arm 310 can be pivoted (swung) relative to and in a plane parallel to base lid 301, together with winding arm post 307, upon loosening of nut 348. In a preferred embodiment, the nut is externally serrated and is located in position along a slot 342 before the winding arm post having corresponding internal and mating serrations is slid thereonto at the desired angular orientation, so that the orientation of winding arm 310 can quickly be changed, without need to release the nut. This serrated nut alternative, with corresponding internal component serrations, can be adopted for the other components to be mounted on the base board.

Winding arm 310 includes winding head 356 in which is located finger bowl 358. Finger bowl 358 is part of a rotatable sub-assembly, in the form of a disc plate, and which is held in position on winding head 356 by four clips 362. Rotation of the said sub-assembly, as by a twirling action of a finger in finger bowl 358, acts to rotate driver tip 312 and since in use this driver tip 312 is engaged in cassette drive 14 the cassette drive 14 is rotated also to expose a different length of the free run R of the ribbon to be re-inked. Although finger bowl 358 has a smooth internal surface, in a further alternative embodiment, the finger bowl 358 has its internal surface serrated or roughened to assist the rotational finger grip. The crank arm of FIG. 1 can be used instead of the finger bowl, in one embodiment with a removable (for storage) finger-hold normally held in a recess by a pair of outwardly biassed spring fingers.

Driver tip 31 is positioned on the axis of sub-assembly 360, and in this embodiment has corrugations 364 on its opposed flat faces, the flat faces being thereby retained.

In this embodiment the winding head 310 is held perpendicular to winding arm post 307 by a support secured to the arms 370 of winding head 310, the support in use resting upon the base lid 301; but in an alternative embodiment, the support can be dispensed with, the winding head being then held up simply by the engagement of driver tip 312 in cassette drive 14.

Figure 27:
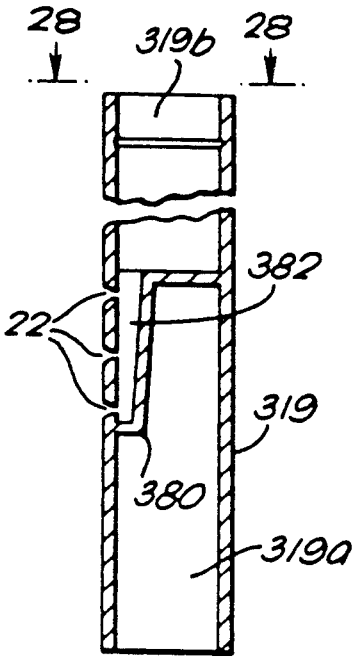
FIG. 27 is a side section of the ink cartridge.
Figure 28:
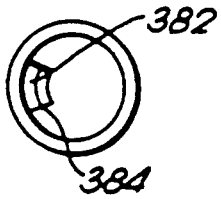
FIG. 28 is a view on the line 28—28 of FIG. 27.
Figure 29:
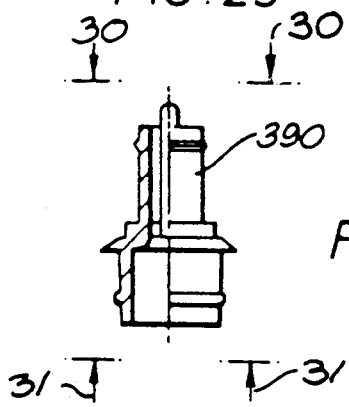
FIG. 29 is a side elevation of a cartridge valve, partly in section.
Figure 30:
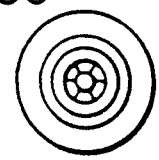
FIG. 30 is a view along the line 30—30 of FIG. 29.
Figure 31:
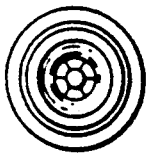
FIG. 31 is a view along the line 31—31 of FIG. 29.
Figure 32:
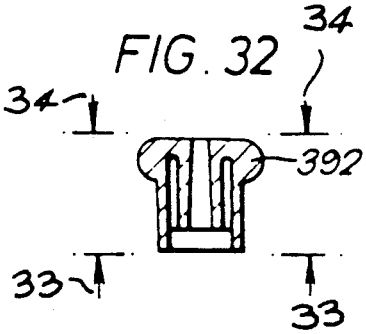
FIG. 32 is a section in side elevation of a valve cap for the ink cartridge.
Figure 33:
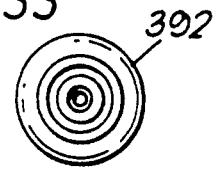
FIG. 33 is a view on the line 33—33 of FIG. 32.
Figure 34:
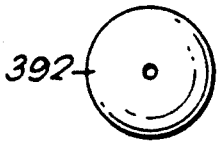
FIG. 34 is a view on the line 34—34 of FIG. 32.

Reservoir cartridge 319 is best seen in FIG. 27. It includes a lower portion 319*a* and an upper portion 319*b* separated by a dividing wall 380. Dividing wall 380 is shaped to provide a flow passage 382 leading to three vertically spaced apertures 22 through the wall of the cartridge, one or more of which can be uncovered to alter the position and amount of ink dispensed; flow passage 382 has radial side edges 384 with an included angle of 60 degrees. Lower part 319*a* of the cartridge can fit against shoulder 385 (FIG. 26) of cartridge base 386, this cartridge base having an annular cup portion 388 adapted to retain ink which leaks from apertures 22. Upper portion 319*b* of the cartridge can receive a cartridge valve 390 (FIG. 29), which in turn can receive a cartridge cap 392 (FIG. 32), the cartridge valve and cartridge cap functioning together to control admission of air to the interior of the cartridge and thus the permitted outflow rate of liquid ink through one or more of orifices 22; the valve and cap are rotatable on upper portion 319*b* either to cut off the flow of air and thus the flow of ink or to regulate the rate of flow.

Cartridge 319 when emptied, or if a different colour printing is desired, can be replaced by a similar (but filled) cartridge, without need to change the cartridge base or cartridge valve or cap i.e. these can be re-used if the replacement cartridge is supplied ready-sealed with a throw-away cap or destroyable closure.

In use, an individual proprietary design of cassette 13, for instance as seen in FIG. 25, sits upon shoulder 316*a* and is located by upstanding projection 316*b*. If required by the cassette design, and as seen in FIGS. 21/22, the free run R of the ribbon being re-inked can pass around an idler roller 320, also secured to the base lid 301 by way of a screw 17 and nut 348.

I claim:

1. A re-linking device for a cassette-housed fabric ribbon, the cassette being of the type having a ribbon discharge opening and a ribbon feed opening with an exposed free run section of the ribbon therebetween, the cassette having a rotatable drive mechanism to feed ribbon between said discharge opening and said feed opening to expose a replacement free run section of the ribbon, the device comprising a base upon which is mounted cassette support means, cassette location means, rotational drive means for association with the cassette drive mechanism, and reservoir means having an ink dispensing outlet engageable by the free run section of the ribbon, each of the said support means, the said location means, the said rotational drive means and the said reservoir means being to one side of the base, and each of the said support means, the said location means, the said rotational drive means and the said reservoir means each being movable to a different area of the base.

2. A re-inking device according to claim 1 wherein the cassette support means comprises four support surfaces, and wherein the cassette location means comprises four location surfaces, the location surfaces being perpendicular to the support surfaces, the location surfaces and the support surfaces being movable individually to a different location on the base.

3. A re-inking device according to claim 1 wherein the base is formed as a base board having more than four holes therethrough, each hole being adapted to provide a mounting location alternately for said cassette support means, said cassette location means, said rotational drive means, and said reservoir means.

4. A re-inking device according to claim 1 wherein the base is formed as a base board having more than four longitudinal parallel slots, each of said support means, said location means, said rotational drive means and said reservoir means including a mounting locator slidable within, and lockable at a selected position along, any one of said slots.

5. A re-inking device according to claim 3 or claim 4 which includes a container and a container removable lid, wherein the base board is said lid, the container being adapted for retaining the said means when the said means are dismounted from the base.

6. A re-inking device according to claim 1 wherein the base is formed as a base structure including at least one guide rail, the cassette support means being a pair of support bars slidably mounted on the guide rail, the cassette location means including pairs of stoppers slidably mounted on each support bar.

7. A re-inking device according to claim 1 wherein the rotational drive means is axially adjustable towards and away from the cassette drive mechanism, and wherein the rotational drive means includes a replaceable adaptor means, the adaptor means having a drive portion operatively engageable under the weight of the rotational drive means with the cassette drive mechanism.

8. A re-inking device according to claim 1 wherein the reservoir means includes a reservoir mounting section and a hollow ink holding chamber, the chamber having a wall with at least one orifice through which ink can be dispensed, means to regulate the flow of ink through the orifice, and a divider wall separating the chamber from the said reservoir mounting section.

9. A re-inking device according to claim 8 wherein the said reservoir mounting section has a first part integral with the ink holding chamber and a second base part removably attached to the ink holding chamber, the second base part providing a holder and an ink trap, a projection on the first part and a recess in the second base part, the holder receiving the first base part at an orientation determined by the said projection on the first part which cooperates with the said recess in the second base part, the ink trap receiving ink from the orifice not removed by the ribbon, a nut mounted on the base, the second part being internally recessed and being removably received on said nut, a serrated internal surface on said second base part and a complementary serrated external surface on said nut, the said second base part being removably received on said nut at selected angular orientations determined by said serrations.

10. A cassette-housed endless fabric ribbon re-inking device, the cassette being of the type having a ribbon exit and a ribbon entrance with an external free run section of the ribbon therebetween, the cassette having a rotatable drive mechanism to draw ribbon from said exit and feed it into said entrance, the device comprising a base, combined cassette support and location means, first means to removably secure said combined cassette support and location means to said base, said support and location means including respective support and locating surfaces each spaced from the base, rotational drive means cooperable with the cassette drive mechanism, second means to removably secure said rotational drive means to said base, a pivot post, third means to removably secure said pivot post to the base, the rotational drive means being swingably located on the pivot post, an ink dispensing outlet, fourth means to removably secure the said ink dispensing outlet to said base, the said ink dispensing outlet being engageable by the said external free run section of the ribbon, each of the said combined cassette support and location means, the said rotational drive means and the said ink dispensing outlet being to one side of the base, and each of the said combined cassette support and location means, the said rotational drive means and the said ink dispensing outlet being securable to more than one area of the base.

11. A device according to claim 10 wherein each of the said combined cassette support and locating means, rotational drive means and ink dispensing outlet is securable at alternative angular orientations to said base.

12. A device according to claim 10 wherein the base has raised portions, the said raised portions defining parallel slots, retention screws slidably located in said slots, the screws each having a head retained in the slot and a threaded stem projecting from between said raised portions to said one side of the base, a tapped recess in each of the combined cassette support and locating means, the rotational driving means and the ink dispensing outlet, the recess being threaded complementarily to the screw stem.

13. A device according to claim 10 wherein the base has raised portions, the said raised portions defining parallel slots, retention screws slidably located in said slots, each screw having a head retained in the slot and a threaded stem projecting through a slot to said one side of the base, a nut internally threaded complementarily to said stem and received thereon, external axially-extending serrations on the nut, a recess in each one of the combined cassette support and locating means, the rotational driving means and the ink dispensing outlet, each said recess being complementarily serrated to said axially-extending serrations, each said recess being removably located on the serrations of said nut at a preselected angular location.

14. A device for re-inking a used fabric ribbon stored in a cassette, said cassette having a drive mechanism for returning the ribbon to the interior of the cassette, the device comprising {a} a base;

{b} components removably mounted on said base, said components comprising

{1} cassette support means,

{2} cassette location means

{3} drive means cooperable with the cassette drive mechanism, said drive means including:

{a} a driver and

{b} a driver rotational means;

{4} reservoir means containing ink usable for re-inking the ribbon;

{c} the said components being mounted to one side of the base;

{d} each of the said components being individually movable to a different location with respect to the base.

15. A device according to claim 14 wherein the support means and the location means comprise four studs, each stud having a support surface parallel to the base and a location surface perpendicular to the base, the studs being removably mounted at different locations on the base.

16. A device for re-inking a used fabric ribbon stored in a cassette, said cassette having a drive mechanism for withdrawing the ribbon from the interior of the cassette and for returning the ribbon back into the interior of the cassette, the device including a base, re-inking components mounted on said base at one of a group of preselected positions, said base being horizontal in use, the drive mechanism facing upwardly, each of said components being above said base, and comprising {a} four combined support and location means, {b} a rotatable drive means cooperable with the cassette drive, {c} a drive post, said rotatable drive means being swingable about said post;

{d} ink dispensing means, and

{e} regulating means to control the rate of ink dispensation from said ink dispensing means.

17. A device according to claim 16 wherein the base has parallel slots, and means to lock the components at selected positions along a slot.

* * * * *